US006516876B1

(12) United States Patent
Jennings

(10) Patent No.: US 6,516,876 B1
(45) Date of Patent: Feb. 11, 2003

(54) RUNNING TOOL FOR SOFT LANDING A TUBING HANGER IN A WELLHEAD HOUSING

(75) Inventor: Charles E. Jennings, Houston, TX (US)

(73) Assignee: ABB Vetco Gray Inc., Houston, TX (US)

( * ) Notice: Subject to any disclaimer, the term of this patent is extended or adjusted under 35 U.S.C. 154(b) by 0 days.

(21) Appl. No.: 09/935,304

(22) Filed: Aug. 22, 2001

Related U.S. Application Data

(60) Provisional application No. 60/229,578, filed on Aug. 31, 2000.

(51) Int. Cl.[7] ..... E21B 19/18

(52) U.S. Cl. ..... 166/77.51; 166/348; 166/368; 166/208; 166/88.4; 166/89.3

(58) Field of Search ..... 166/85.1, 368, 166/348, 374, 382, 89.3, 88.4, 208, 77.51

(56) References Cited

U.S. PATENT DOCUMENTS 4,067,062 A 1/1978 Baugh ..... 166/125
4,386,656 A * 6/1983 Fisher et al.
5,247,997 A * 9/1993 Puccio
6,082,460 A 7/2000 June ..... 166/348

* cited by examiner

*Primary Examiner*—Roger Schoeppel
(74) *Attorney, Agent, or Firm*—Bracewell & Patterson, L.L.P.

(57) ABSTRACT

A running tool for a wellhead has an outer sleeve, a piston, an inner sleeve, each with respective hydraulic chambers, and a pair of collets for engaging a tubing hanger in a wellhead. Pressure is applied to the various chambers to actuate the collets and engage and/or release the tubing hanger. This process is gradual so that the tubing hanger is landed softly in a production bore of a tree or wellhead. The piston is forced downward to actuate a lower sleeve and move locking dogs into a bore profile to secure the tubing hanger. This process is reversed to release the collets and detach the running tool from the tubing hanger. The running tool is then brought back to the surface without the tubing hanger, which remains landed in the bore.

11 Claims, 3 Drawing Sheets

RUNNING TOOL FOR SOFT LANDING A TUBING HANGER IN A WELLHEAD HOUSING

This patent application is based upon provisional patent application Ser. No. 60/229,578, filed Aug. 31, 2000.

TECHNICAL FIELD

This invention relates in general to an improved running tool, and in particular to an improved running tool for soft landing a tubing hanger in a wellhead housing.

BACKGROUND OF THE PRIOR ART

Designs for landing tubing hangers in casing hangers for wells in the ocean floor are well known in the prior art. A tubing hanger typically carries or suspends one or more strings of tubing which extend down into the subsea well. Many different tubing hanger designs exist and are the subject of numerous prior art patents. Some of the earlier versions of tubing hangers required a running tool employing a dart for operation that restricted the bore of the tubing hanger. Other designs provide a running tool allowing full bore tubing access during running, while providing means for controlling downhole safety valves during both running and landing operations.

For example, in U.S. Pat. No. 4,067,062, the tubing hanger is lowered into the well and releasably secured to the casing hanger by hydraulic manipulation of the running tool after the tubing hanger has been oriented in the casing hanger. After further hydraulic manipulation, the running tool may be released from the hydraulic set tubing hanger and later run back into the well and reconnected to the tubing hanger for retrieval. Although each of these designs are workable, it is difficult to avoid "hard" landing and possibly damaging the tubing hanger in the well due to the depths at which the subsea wells are typically located. Thus, an improved design for "soft" landing a tubing hanger in a wellhead is needed.

SUMMARY OF THE INVENTION

In one embodiment of the present invention, a running tool for a tubing hanger has multiple passages with respective chambers. The running tool has an outer sleeve, a piston, and an inner sleeve in their upper positions such that a pair of collets are released from a tubing hanger and the running tool is detached from the tubing hanger. After a horizontal production tree is installed on the wellhead, the operator connects a string of tubing and the running tool to the tubing hanger. When pressure is applied to an upper inner sleeve chamber and released from a lower inner sleeve chamber, the inner sleeve moves down to capture the collets and engage the tubing hanger. The operator runs the assembly into the well.

The upper inner sleeve chamber is initially pressurized and the outer sleeve chamber is locked so that the running tool can be hard-landed in the bore. When the outer sleeve lands in the bore, the impact is absorbed by the running tool, not by the tubing hanger. After the running tool has landed, fluid in the outer sleeve chamber is bled off so that the running tool descends axially relative to the outer sleeve. This process is gradual so that the tubing hanger is landed softly. Next, the piston is forced downward to actuate the lower sleeve, thereby moving locking means into a bore profile to secure the tubing hanger.

After the tubing hanger is landed, the running tool is retrieved by pressurizing the lower inner sleeve chamber and releasing pressure from the upper inner sleeve chamber and the piston chamber to lift the inner sleeve. This action releases the collets to detach the running tool from the tubing hanger. The running tool is then brought back to the surface without the tubing hanger, which remains landed in the bore. At the surface, the inner sleeve is already in the upper position, so the outer sleeve chamber and the upper inner sleeve chamber are re-pressurized to reset the running tool for another job.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE PREFERRED EMBODIMENT OF THE INVENTION

Figure 1:
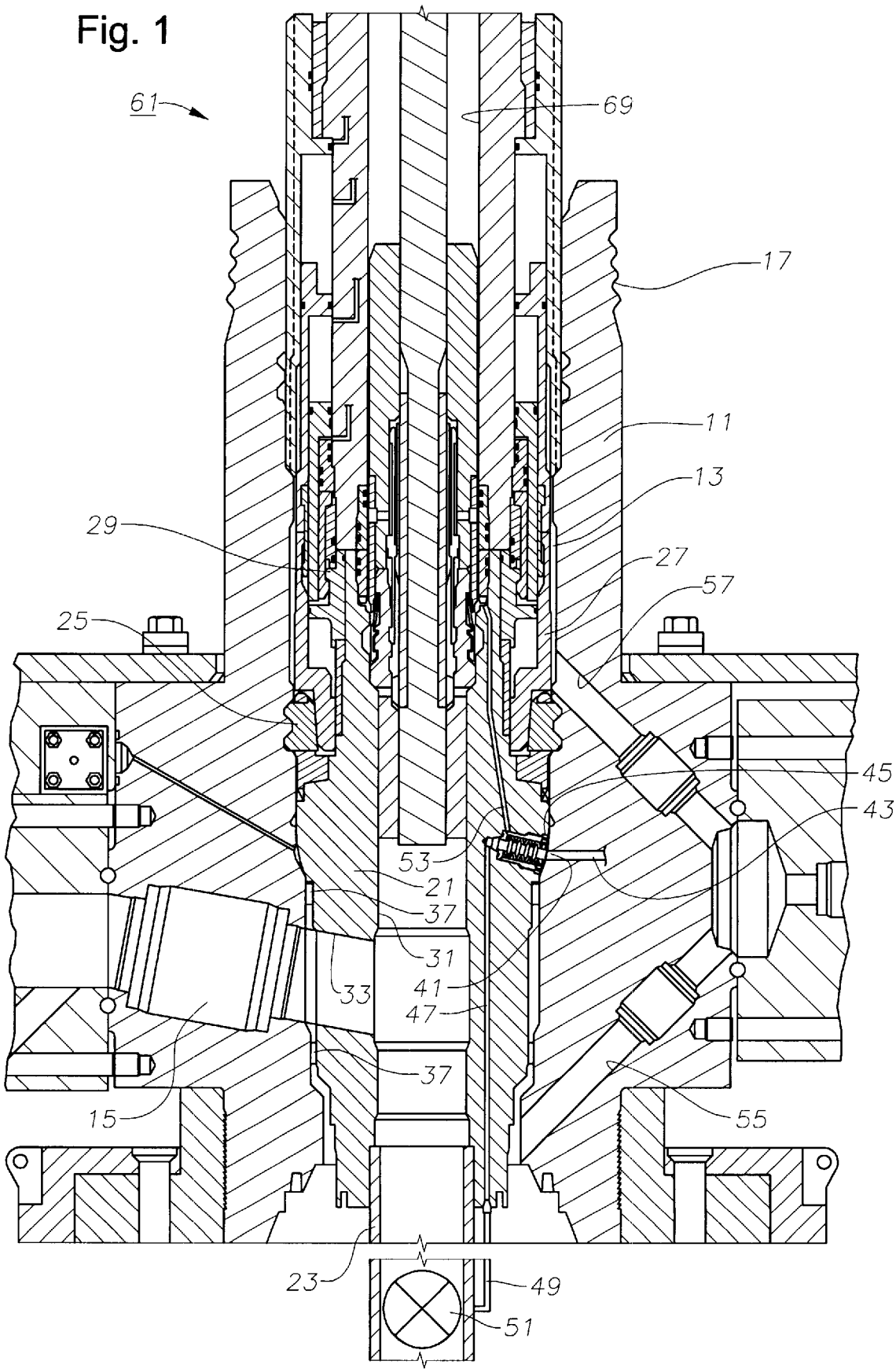
FIG. 1 is a sectional side view of a horizontal tree having a tubing hanger and running tool constructed in accordance with the invention, and is shown with the running tool and tubing hanger landed in the horizontal tree.

Referring to FIG. 1, a production tree 11 is of a type known as a "horizontal tree." Although production tree 11 is depicted as a horizontal tree, it could also be a conventional tree (not shown), wherein the tubing hanger would go in the wellhead below the tree. Production tree 11 lands on a wellhead housing, typically located on the sea floor. Production tree 11 has a vertical bore 13 extending through it. A lateral passage 15 extends from bore 13 for the flow of production fluid. Production tree 11 has a groove profile 17 on its exterior upper end for connection to a riser (not shown) while lowering the tree 11 to the sea floor and during completion operations. Normally the horizontal tree is run with the same tool that runs the wellhead. The tool locks in the grooves in the inner diameter. After installation is complete, a cover (not shown) will be placed over the upper end of production tree 11.

A tubing hanger 21 lands in bore 13 of production tree 11. Tubing hanger 21 supports a string of tubing 23 that extends into the well for the flow of production fluid. Tubing hanger 21 is secured in tree bore 13 by a plurality of dog segments 25. A cam or lower sleeve 27, when moved axially downward, pushes dog segments 25 outward into a profile in bore 13. A collar 29 on the upper end of tubing hanger 21 is used for engaging tubing hanger 21 while lowering it into tree 11.

Tubing hanger 21 has an axial passage 31 and a lateral passage 33 extending therefrom that is rotationally oriented and axially aligned with production tree lateral passage 15. A wireline plug (not shown) will be installed in axial passage 31 above lateral passage 33 to cause production fluid flow to flow out lateral passage 33. Circumferential seals 37 locate above and below lateral passage 33.

Tubing hanger 21 also has a number of auxiliary ports 41 (only one shown) that are spaced circumferentially around it. Each port 41 aligns with a tree auxiliary passage 43 (only one shown) for communicating hydraulic fluid or other fluids for various purposes to tubing hanger 21, and from tubing hanger 21 downhole. In FIG. 1, tree auxiliary passage 43 communicates hydraulic fluid pressure to auxiliary port 41. Tubing hanger 21 has an annular, partially spherical exterior portion that lands within a partially spherical surface 45 formed in tree bore 13. Tree auxiliary passage 43 terminates in spherical surface 45.

Auxiliary port 41 leads to a lower auxiliary passage 47 that extends to the lower end of tubing hanger 21. Lower auxiliary passage 47 connects to a hydraulic line 49 that extends alongside tubing 23 to a downhole safety valve 51. Downhole safety valve 51 allows the flow of production fluid through tubing 23 while hydraulic fluid pressure is supplied to it, and blocks flow in the absence of hydraulic fluid pressure. Tubing hanger 21 also has an upper auxiliary passage 53 extending from auxiliary port 41 to the upper end of tubing hanger 21.

A tubing annulus surrounds tubing 23 within the casing of the well. The tubing annulus communicates with a lower annulus passage 55 extending through tree 11. Lower annulus passage 55 leads to a pair of valves, which in turn connects to an upper annulus passage 57. Lower annulus passage 55 enters tree bore 13 below the lower of the two tubing hanger seals 37. Upper annulus passage 57 enters tree bore 13 above the upper of the two tubing hanger seals 37. Passages 55, 57 thus bypass the seals 37 of tubing hanger 21. Upper annulus passage 57 communicates with the space between collar 29 and running tool 61.

Tubing hanger 21 is installed in production tree 11 with a running tool 61 constructed in accordance with the present invention. Running tool 61 is deployed to run tubing hanger 21 and tubing string 23 into the well after tree 11 has been installed on the wellhead. However, an outer shoulder 63 (FIG. 2) on running tool 61 lands on an inner shoulder 65 (FIG. 3) in tree bore 13 above tubing hanger 21 before tubing hanger 21 lands in tree bore 13. As will be explained below, locking devices or dogs 25 secure running tool 61 in place and tubing hanger 21 seals to bore 13. Running tool 61 has an axial bore 69 (FIG. 1) that registers with tubing hanger axial bore 31.

In the embodiment shown, running tool 61 has a body 71 (FIG. 2) that engages the upper end of tubing hanger 21. Running tool 61 has an outer sleeve 73 that strokes axially relative to body 71 via a sealed outer sleeve chamber 75 between body 71 and outer sleeve 73. Outer sleeve chamber 75 is supplied with hydraulic fluid via a fluid passage 77 extending through body 71. When outer sleeve 73 is in the lower position of FIGS. 2 and 3, chamber 75 is located below passage 77. When outer sleeve 73 is in the upper position of FIG. 4, chamber 75 is displaced by outer sleeve 73. Outer sleeve 73 is always below or in communication with passage 77.

Running tool 61 has an intermediate member or sealed piston 79 between body 71 and outer sleeve 73. Like outer sleeve 73, piston 79 strokes axially relative to body 71 via a sealed piston chamber 81 between body 71 and piston 79. Piston chamber 81 is supplied with hydraulic fluid via a second fluid passage 83 extending through body 71. When piston 79 is in the upper position of FIGS. 2 and 3, piston 79 retains a collet 85 at the upper end of a lower sleeve 27. In the lower position of FIG. 4, piston 79 lowers collet 85 and axially engages the upper end of lower sleeve 27. As piston 79 pushes downward on lower sleeve 27, the lower end of lower sleeve 27 biases dogs 25 downward and outward into locking engagement with tree bore 13 (FIG. 4).

Figure 2:
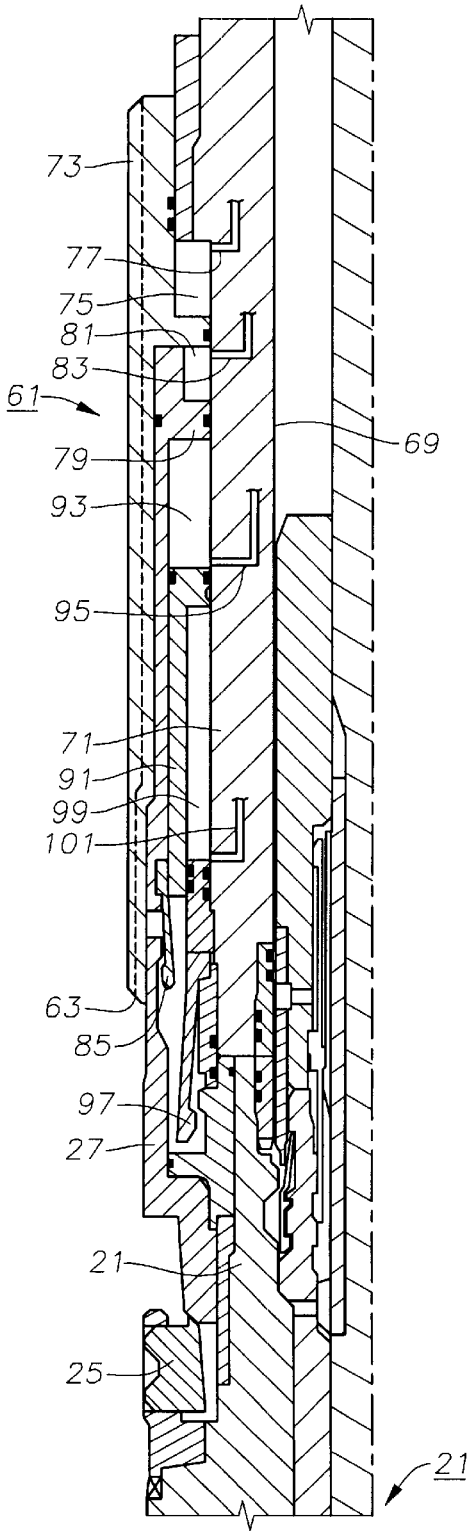
FIG. 2 is an enlarged sectional side view of one half of an upper end of the running tool of FIG. 1, shown prior to landing.

Running tool 61 also has a sealed inner sleeve 91 between body 71 and piston 79. Inner sleeve 91 strokes axially relative to body 71 via a sealed, upper inner sleeve chamber 93 between body 71 and inner sleeve 91. Inner sleeve chamber 93 is supplied with hydraulic fluid via a third fluid passage 95 extending through body 71. In the upper position of FIG. 2, inner sleeve 91 releases a collet 97 from the upper end of tubing hanger 21. In FIG. 2, inner sleeve 91 is shown in the upper position in FIG. 2 and collets 85, 97 are shown unlocked to better illustrate their respective ranges of motion. When inner sleeve 91 is in the fully up position, both collets 85, 97 are released from tubing hanger 21. In reality, when running tubing hanger 21, inner sleeve 91 is all the way down and collets 85, 97 are locked, as shown in FIG. 3, except that the assembly is not yet landed in production tree 11.

Figure 3:
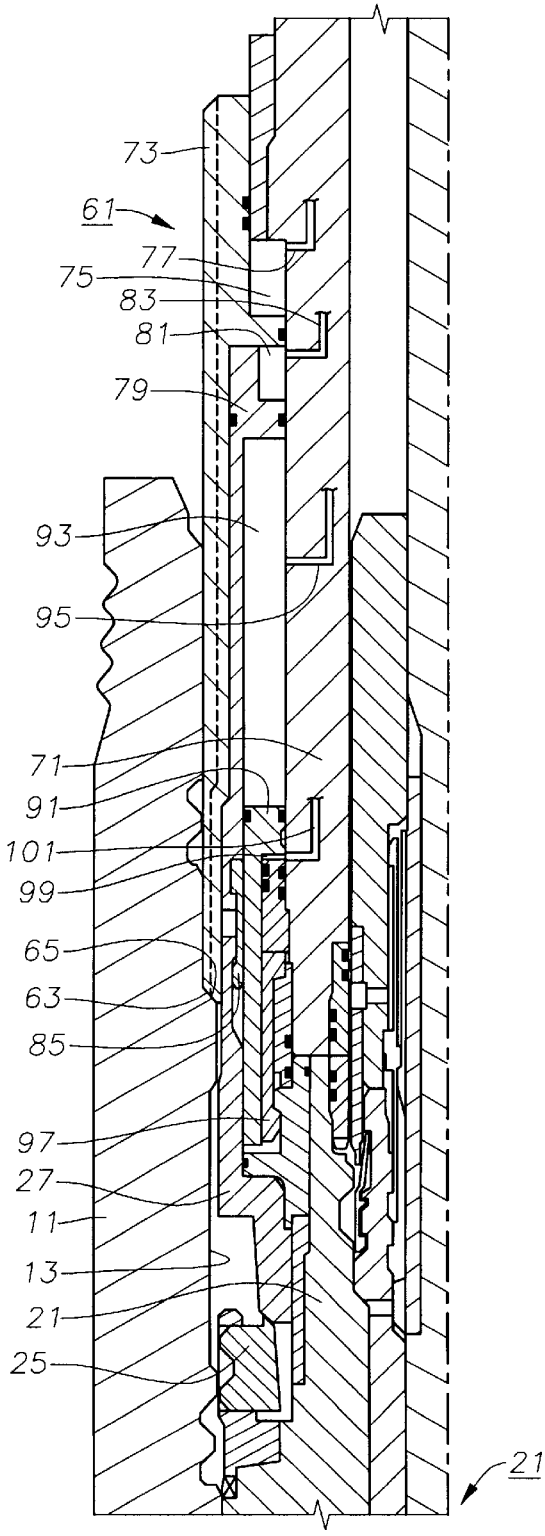
FIG. 3 is an enlarged sectional side view of an upper end of one half of the horizontal tree and running tool of FIG. 1, shown during the landing sequence.
Figure 4:
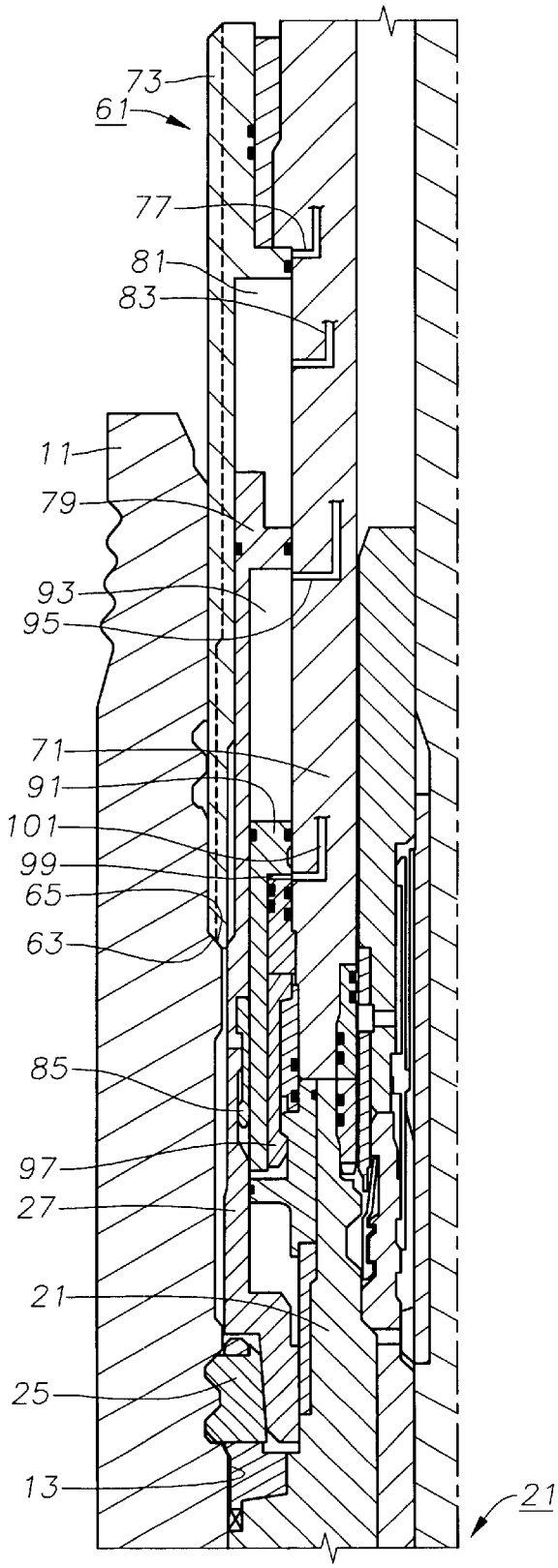
FIG. 4 is an enlarged sectional side view of an upper end of one half of the horizontal tree and running tool of FIG. 1, shown after landing and locked to the horizontal tree.

In the lower position of FIGS. 3 and 4, inner sleeve 91 retains lower sleeve 27 by locking collet 97 inward. As piston 79 pushes downward on lower sleeve 27, the lower end of lower sleeve 27 biases dogs 25 downward and outward into locking engagement with tree bore 13 (FIG. 4). A sealed, lower inner sleeve chamber 99 (best shown in FIG. 2) is located below inner sleeve 91 opposite upper inner sleeve chamber 93 and has a fluid passage 101 for supplying hydraulic pressure to selectively return inner sleeve 91 to the upper position. Thus, fluid moving in and out of chambers 93, 99 actuate inner sleeve 91 to operate collets 85, 97 relative to tubing hanger 21.

In operation, hydraulic fluid sources are connected to running tool 61 for passages 77, 83, 95, 101 and their respective chambers. At this stage (FIG. 2), outer sleeve 73 is in the upper position, and piston 79 and inner sleeve 91 are in their upper positions. In reality, inner sleeve 91 and passage 95 would be slightly higher than shown so that collet 85 also would be unlocked. In this configuration, collets 85 and 97 are released from tubing hanger 21 such that running tool 61 is detached from tubing hanger 21.

After tree 11 is installed on the wellhead, the operator at the surface connects a string of tubing 23 and running tool 61 to tubing hanger 21. When pressure is applied to upper inner sleeve chamber 93 and released from lower inner sleeve chamber 99 (shown in FIG. 3), inner sleeve 91 moves down to capture collets 85, 97 and engage tubing hanger 21. The operator runs the assembly into the well. When tubing hanger 21 enters bore 13, it will be rotationally oriented by an orienting device to align horizontal passage 33 with horizontal passage 15.

As shown in FIG. 3, upper inner sleeve chamber 93 is initially pressurized and outer sleeve chamber 75 is blocked so that running tool 61 can be hard-landed in bore 13. When the outer shoulder 63 on outer sleeve 73 lands on inner shoulder 65 in bore 13, the impact is absorbed by running tool 61, not by tubing hanger 21. After running tool 61 has landed in bore 13, the hydraulic fluid in outer sleeve chamber 75 is bled off so that running tool 61 descends axially relative to outer sleeve 73. This process is gradual so that tubing hanger 21 is landed "softly" or relatively slowly on spherical surface 45 as indicated sequentially in FIGS. 3 and 4. Next, hydraulic pressure applied to piston chamber 81 forces piston 79 downward to actuate lower sleeve 27, thereby moving dogs 25 into the profile in bore 13 to secure tubing hanger 21 therein.

After tubing hanger 21 is landed in bore 13, running tool 61 is retrieved by pressurizing lower inner sleeve chamber 99 and releasing pressure from upper inner sleeve chamber 93 and piston chamber 81 (shown in FIG. 2) to lift inner sleeve 91. This action releases collets 97, 85, respectively, to detach running tool 61 from tubing hanger 21. Running tool 61 is then brought back to the surface without tubing hanger 21, which remains landed in bore 13. At the surface, inner sleeve 91 is already in the upper position, so port 101 of chamber 99 is blocked and outer sleeve chamber 75 and upper inner sleeve chamber 93 are re-pressurized to reset running tool 61 for another job.

The invention has the advantage of absorbing the hard impact of a landing in a tree or wellhead production bore with the running tool, rather than with the tubing hanger. After the running tool has been landed in the wellhead, the tubing hanger is gently or softly landed within the production tree via a hydraulic mechanism located within the running tool.

While the invention has been shown or described in only some of its forms, it should be apparent to those skilled in the art that it is not so limited, but is susceptible to various changes without departing from the scope of the invention.

What is claimed is:

1. A running tool for soft landing a tubing hanger in a production bore of a tree or wellhead, comprising:

a running tool body for supporting a tubing hanger;

hard landing means mounted to the body for hard landing the body in a bore and absorbing an impact thereof;

soft landing means mounted to the body for moving the body relative to the hard landing means to soft land the tubing hanger in the bore; and locking means mounted to the body and adapted to lock and unlock the tubing hanger relative to the bore.

2. The running tool of claim 1 wherein the hard landing means and the locking means are independently hydraulically actuated.

3. The running tool of claim 1 wherein each of the hard landing means and the locking means are axially movable relative to the body.

4. The running tool of claim 1, further comprising means for detachably coupling the tubing hanger to the body.

5. A running tool for soft landing a tubing hanger in a production bore of a tree or wellhead, comprising:

a body adapted to retain a tubing hanger;

a sleeve mounted to the body for hard landing the body in a production bore and absorbing an impact thereof;

a piston mounted between the body and the sleeve, wherein the piston is adapted to lock and unlock the tubing hanger relative to the production bore; and wherein the body moves relative to the sleeve to soft land the tubing hanger in the production bore.

6. The running tool of claim 5 wherein the sleeve and the piston are independently actuated via hydraulic means.

7. The running tool of claim 5 wherein each of the sleeve and the piston are axially movable relative to the body.

8. The running tool of claim 5, further comprising:

an inner sleeve mounted between the body and the piston;

a collet located between the body and the inner sleeve that is adapted to retain the tubing hanger on the body via the inner sleeve.

9. The running tool of claim 5, further comprising:

a collet located between the piston and the body;

a lower sleeve retained on the body by the collet; and wherein the piston engages the lower sleeve to lock and unlock the tubing hanger in the production bore.

10. A running tool for soft landing a tubing hanger in a production bore of a tree or wellhead, comprising:

a body;

an axially movable outer sleeve mounted to the body;

an axially movable piston mounted between the body and the outer sleeve;

an axially movable inner sleeve mounted between the body and the piston;

an outer collet located between the piston and the inner sleeve;

a lower sleeve retained on the body by the outer collet;

an inner collet located between the body and the inner sleeve that is adapted to retain a tubing hanger on the body; wherein the outer sleeve has a lower position that is adapted to hard land the body in a production bore, and an upper position that is adapted to soft land the tubing hanger in the production bore after the outer sleeve has landed; and wherein the piston has an upper position for disengaging the lower sleeve from locking the tubing hanger to the production bore, and a lower position for engaging the lower sleeve to lock the tubing hanger in the production bore.

11. The running tool of claim 10 wherein the outer sleeve, the piston, and the inner sleeve are independently actuated via hydraulic means.

* * * * *